United States Patent [19]

Targetti

[11] Patent Number: 4,866,581

[45] Date of Patent: Sep. 12, 1989

[54] LINEAR STRUCTURAL MEMBER HAVING A DRAWN SECTION AND HAVING WEIGHT-REDUCING SLOTS

[76] Inventor: Giampaolo Targetti, Via Barbacane No. 29, 50133 Firenze, Italy

[21] Appl. No.: 152,628

[22] Filed: Feb. 5, 1988

[30] Foreign Application Priority Data

Feb. 19, 1987 [IT] Italy ..... 11545/87[U]
Dec. 11, 1987 [IT] Italy ..... 1824/87[U]

[51] Int. Cl.[4] ..... F21S 3/00

[52] U.S. Cl. ..... 362/219; 362/249; 362/225; 248/343

[58] Field of Search ..... 362/217, 219, 225, 147, 362/266, 404, 249, 430, 368, 285; 248/342, 343; 52/28

[56] References Cited

U.S. PATENT DOCUMENTS 2,606,278 8/1952 Smith ..... 362/219
3,265,886 8/1966 Wigert ..... 362/219
3,297,075 1/1967 Howell et al. ..... 362/219 X
3,349,237 10/1967 Jackson ..... 362/219
3,780,973 12/1973 Dalton, Jr. ..... 248/342
4,620,268 10/1986 Ferenc ..... 362/219 X
4,712,165 12/1987 Cetrone ..... 362/219 X

FOREIGN PATENT DOCUMENTS 452193 10/1948 Canada ..... 248/342
2169391 7/1986 United Kingdom ..... 362/260

*Primary Examiner*—Ira S. Lazarus
*Assistant Examiner*—Peggy Neils
*Attorney, Agent, or Firm*—Hopgood, Calimafde, Kalil, Blaustein & Judlowe

[57] ABSTRACT

In a linear structural member for the formation of reticulated structures intended to bear lighting means and the like, to form furnishing and for other uses, possessing two mutually spaced longitudinal expanded parts and a connecting part between the latter, said member comprises a single continuous section possessing, as a connecting part, a continuous laminar connecting baffle between the said two expanded parts.

3 Claims, 8 Drawing Sheets

FIG. 2
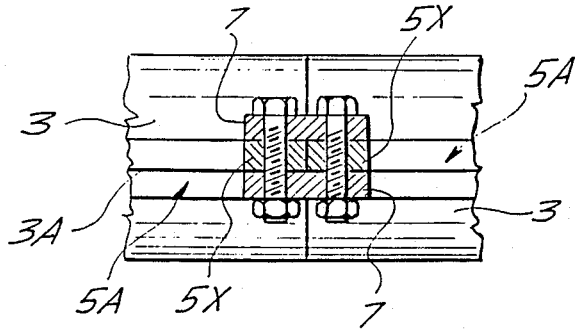
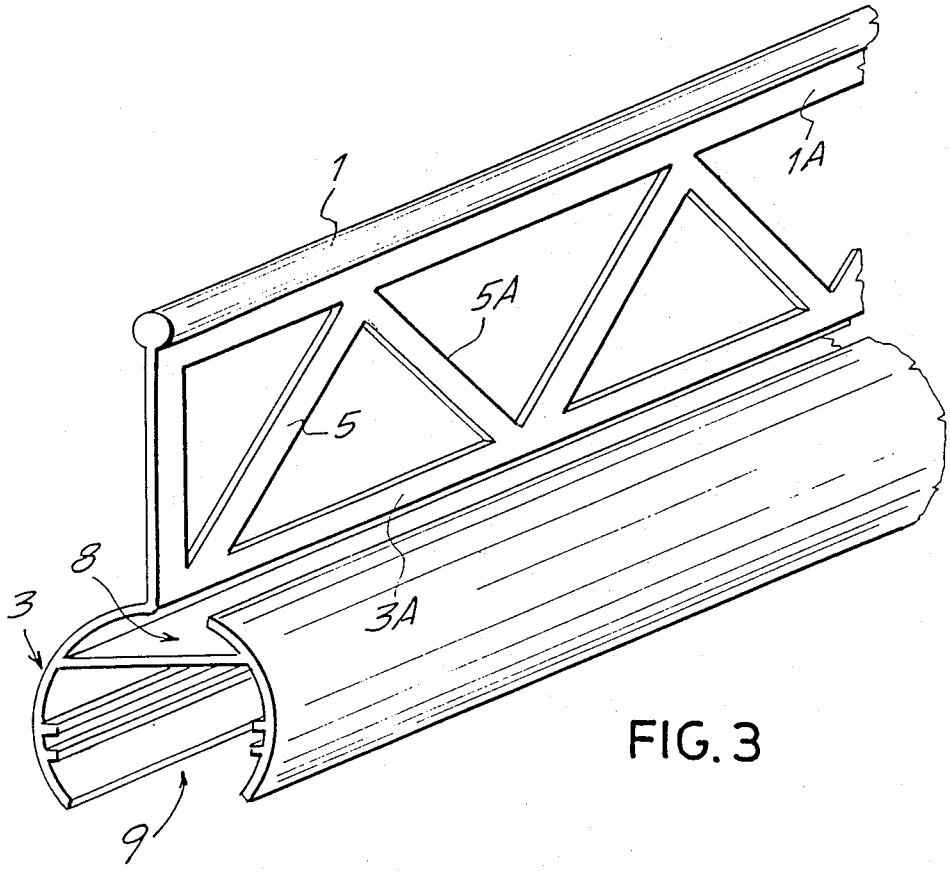
FIG. 3

FIG. 4
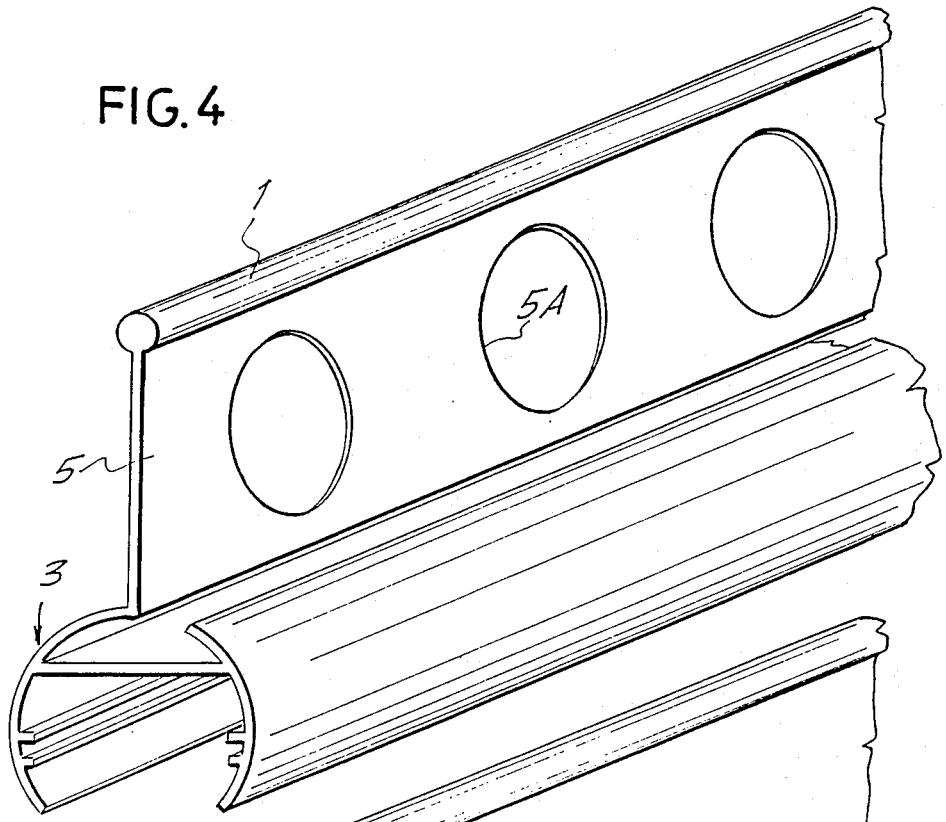
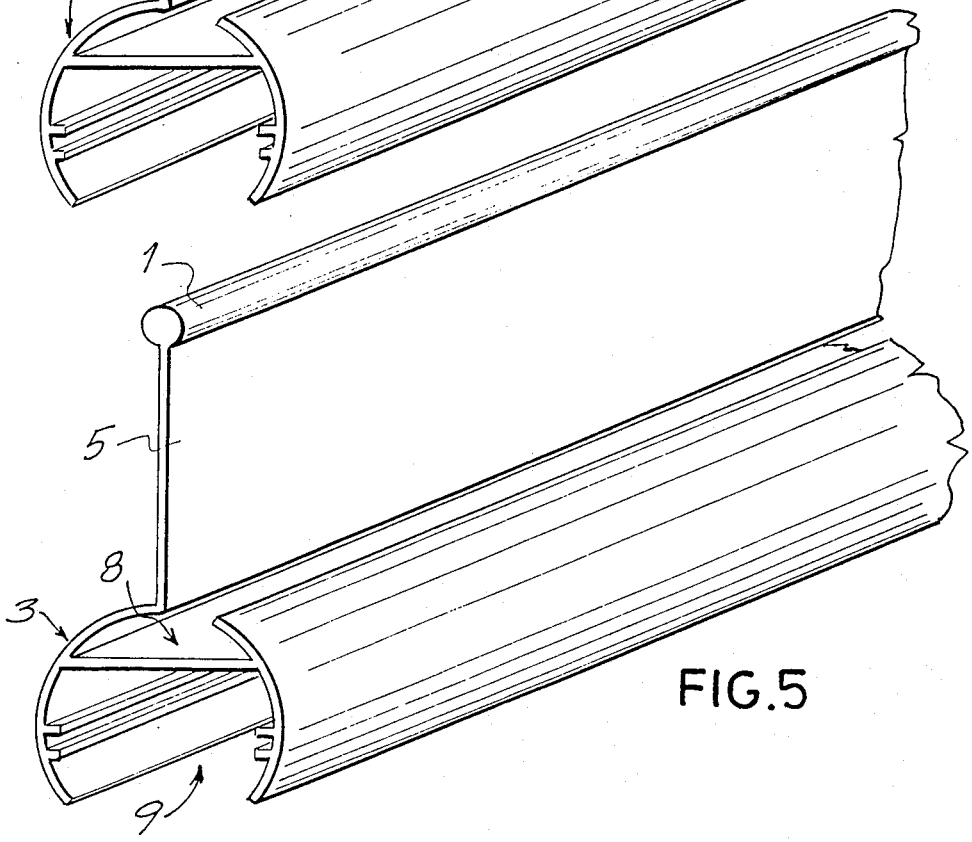
FIG. 5

FIG. 6
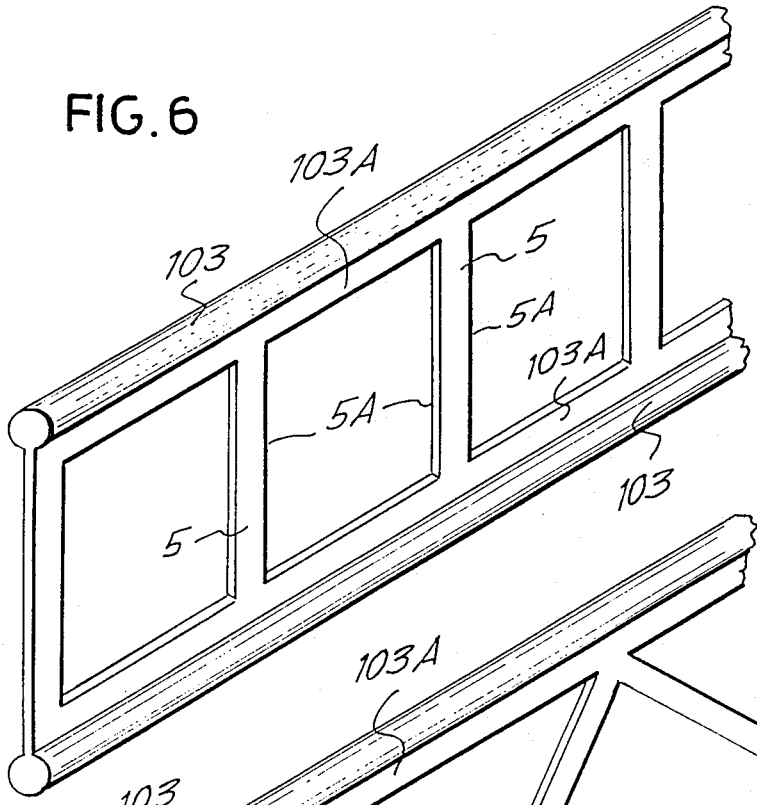
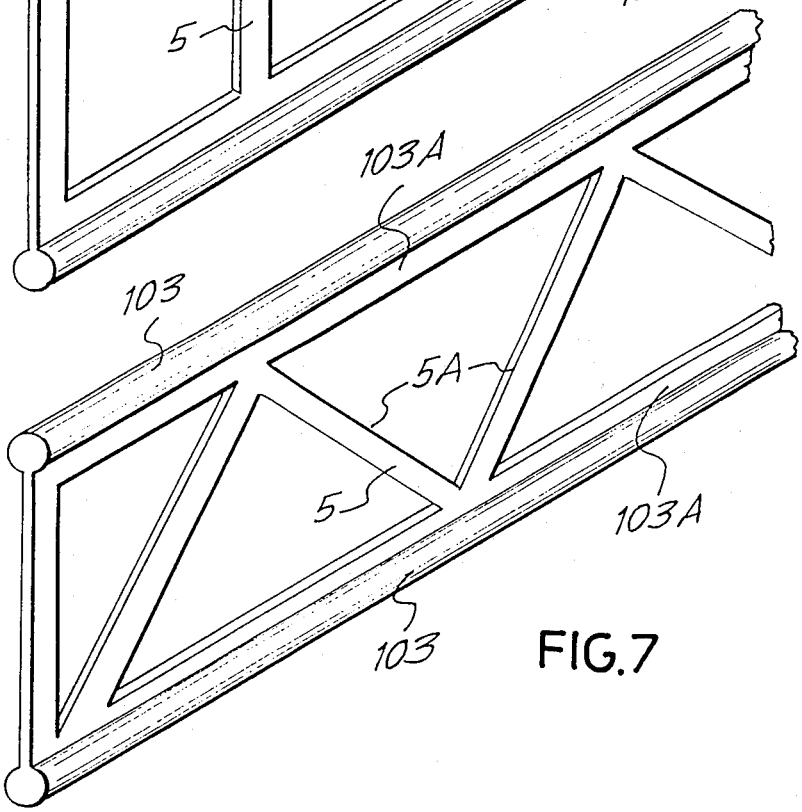
FIG. 7

FIG. 8
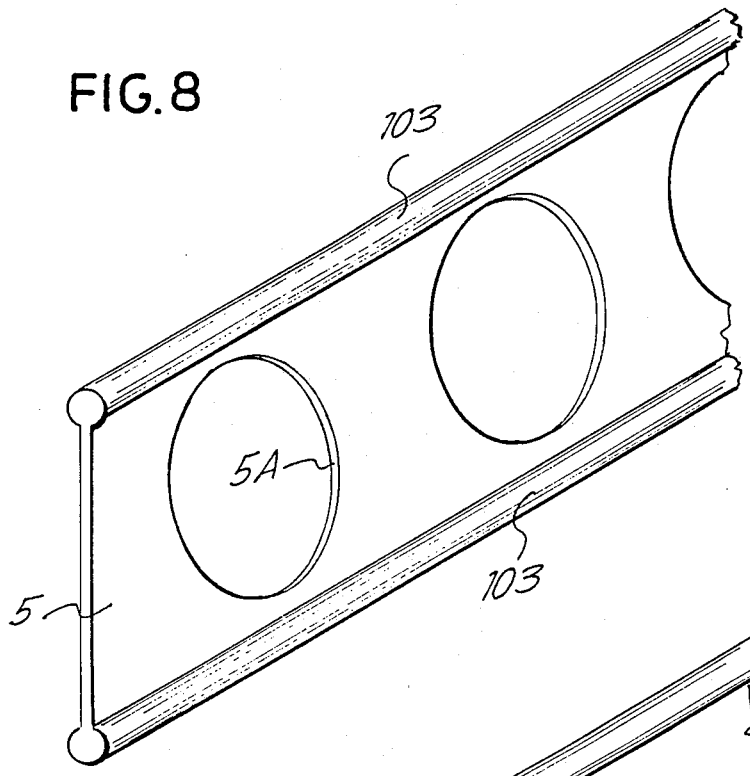
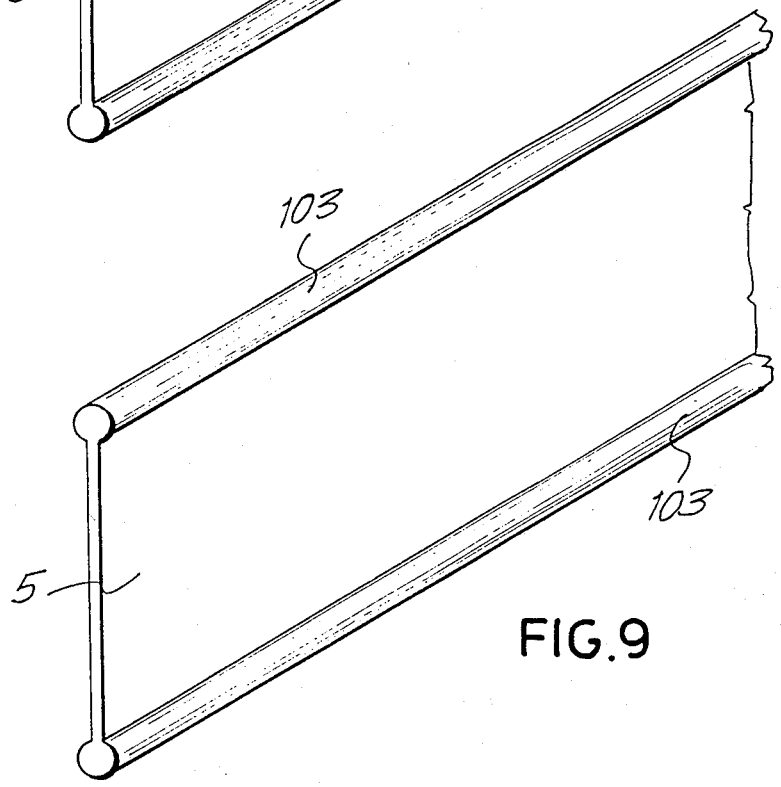
FIG. 9

LINEAR STRUCTURAL MEMBER HAVING A DRAWN SECTION AND HAVING WEIGHT-REDUCING SLOTS

The invention relates to a linear structural member or beam which has been designed in order to produce reticulated structures of relatively light weight, for example for lighting, interior decoration and the like. Another possible use of the linear structural member according to the invention is in combination with an electrified rail.

In order to produce reticulated structures such as those mentioned above, and for other uses, linear structural members have been provided which comprise two mutually spaced longitudinal components and reticulated components of thin section which are fixed to the longitudinal components by welding or the like. In particular, it is possible to provide structural members comprising two bars and uprights or thinner bars which are bent and welded to these longitudinal components. One of the longitudinal components can also be a drawn rail for the fitting of lighting fixtures which are slidable and can be used in variable positions. These structural members give rise to high production costs.

The object of the invention is to provide a linear structural member which is particularly simple, compact and inexpensive, and also very pleasing esthetically.

In essence, according to the invention, a linear structural member of the type mentioned comprises a single continuous section possessing, as a connecting part, a continuous laminar connecting baffle between the said two expanded parts. The said continuous laminar connecting baffle may possess extended cut-out weight-reducing slots. These slots can be developed to maintain continuous ribs along the expanded walls.

Contiguous, abutting segments of the said structural members can be connected by means of splice plates placed side by side and fixed to the ends of laminar baffles which are not affected by slots.

At least one of the said expanded parts may be designed as a drawn rail.

In a modified embodiment, one of the said expanded parts is shaped to engage within a corresponding duct in an electrified rail bearing insertion members for lighting means.

In a practical embodiment, the portion for engaging in the electrified rail possesses end enlargements.

The drawing shows a possible embodiment of the invention, and in particular:

FIG. 2 shows a local section along II—II in FIG. 1, illustrating the assembled components;

FIGS. 3, 4 and 5 show embodiments for producing a drawn rail;

FIGS. 6 to 9 show solutions similar to the previous solution, for structural elements according to the invention;

Figure 1:
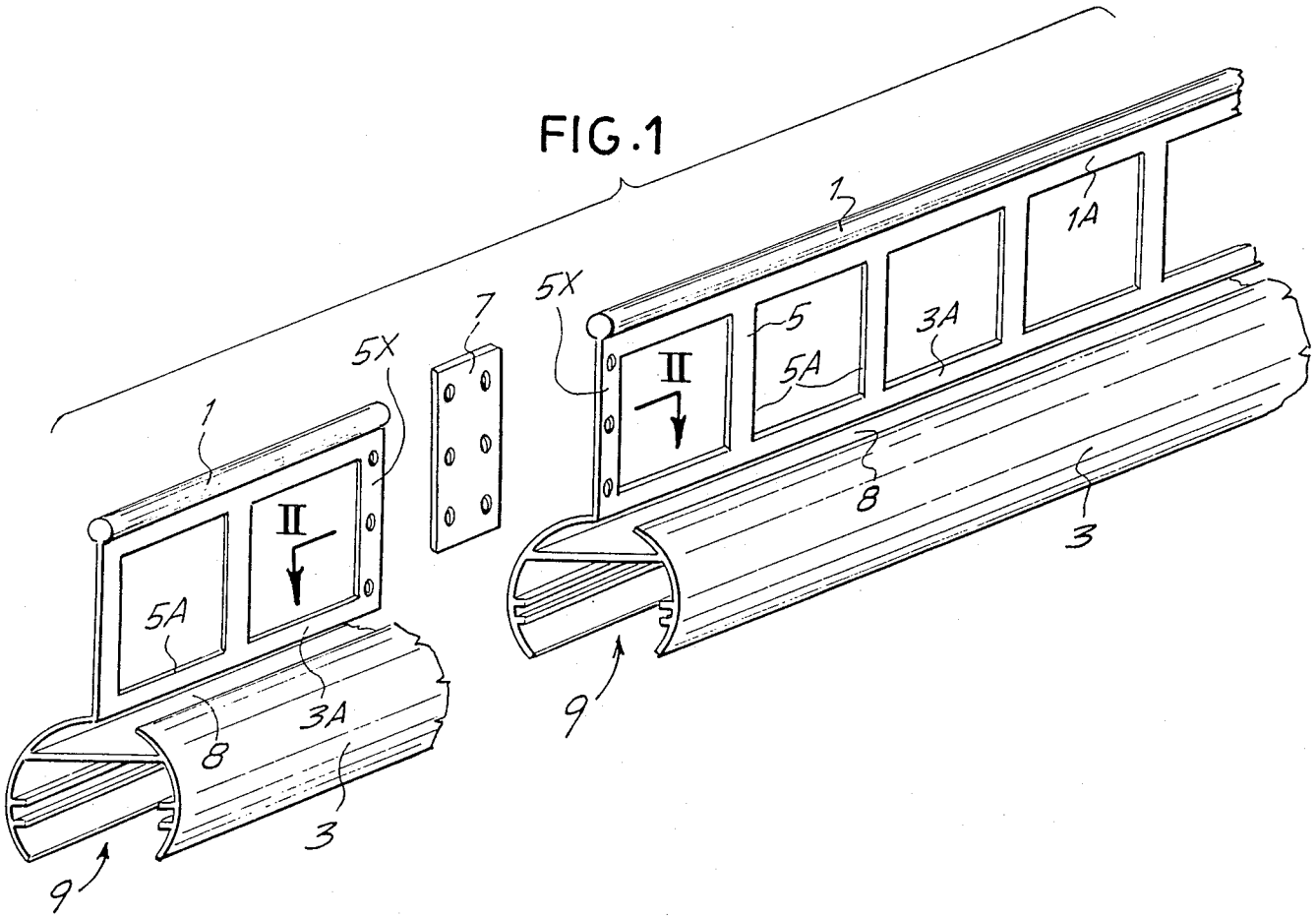
FIG. 1 shows in perspective three components to be assembled, produced in accordance with the invention, for a drawn rail.

According to what is shown in the attached drawings, a linear structural member comprises two expanded parts 1 and 3 or 103 which are developed lengthwise and are of sufficient section to ensure resistance to compression and traction, and a connecting part 5 of slight thickness which is shaped with no break of continuity together with the parts 1 and 3 or 103, in the form of a drawn part made of metal or another material. To ensure a reduction in weight of the structural member concerned, and also for reasons of an esthetic nature, wide slots 5A can be cut in the connecting part 5—which is designed as a laminar baffle—defining connecting components between the two longitudinal parts 1 and 3 or 103, in the form of a lattice; residual portions of the said baffle may also, and advantageously, form a continuous internal rib which extends longitudinally along each of the two parts 1 and 3 or 103, as is shown by 1A and 3A or 103A respectively, which increases the flexural strength of the assembly, increasing the section of parts 1 and 3 or 103 and the strength due to the configuration, thereof.

In order to connect two contiguous and abutting structural members of equal section, it is possible to use snap links or splice plates 7 which are fitted to the end 5X of the connecting part 5 of the two members to be butt-jointed, with bolt-type or other suitable fitting means; it is possible to employ a single plate 7 or two facing plates. The plates 7 or other connecting means ensure, in addition to mechanical connection, any electrical connection and continuity between the two contiguous metal structural members.

FIGS. 1 to 9 show various designs of the structural members according to the invention, which differ among themselves in the design of the slots 5A, which moreover can also be absent, as shown in FIGS. 5 and 9.

FIGS. 6 to 9 show an embodiment in which the two longitudinal parts 103 are substantially mutually equal.

FIGS. 1 to 5 show an embodiment in which, of the two longitudinal parts 1 and 3, one (1) is formed analagously to the part 103 in FIGS. 6 to 9, whereas the other (3) is designed as a drawn rail profile of adequate section, for example of hollow shaped cylindrical section, having a hollow part 8 which opens laterally adjacent to the baffle 5 forming the connecting part between the two components 1 and 3, and having a drawn cavity 9 which contains sliding and electrical-contact rails of a type known per se for the production of lighting systems which are adjustable in position by means of units having appropriately adjustable lamps, such as miniature bulbs or similar lighting groups.

In any event, a linear structural member—to be used in isolation or in combination with others—comprises a section which is usually drawn from a suitable material especially a metallic material when it is also to serve as a current conductor, which offers continuity of structure with advantages of strength and also of esthetic character, and which can be produced with a high degree of economy, practicality and precision of working.

According to what is shown in FIGS. 10 to 13, a linear structural member indicated generically by 201 comprises an expanded part 203 (the upper part in the drawing) running longitudinally along the said member, and a portion 205, 207 extending longitudinally along the edge of the linear web member 201 opposite the expansion 203. The parts 203 and 205, 207 can be extruded integrally with the central portion 209 of the linear member 201 forming a connection between the portions 203 and 205, while parts 205, 207 connect parts 213, 221.

Figure 10:
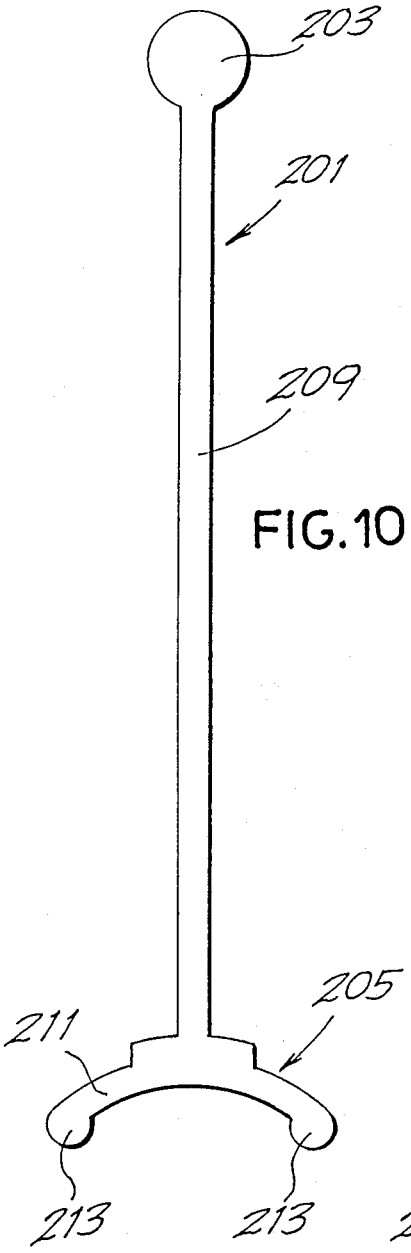
FIGS. 10 and 11 show two transverse sections of a linear member having shaped portions for engaging with an electrified rail, which are mutually equivalent.
Figure 11:
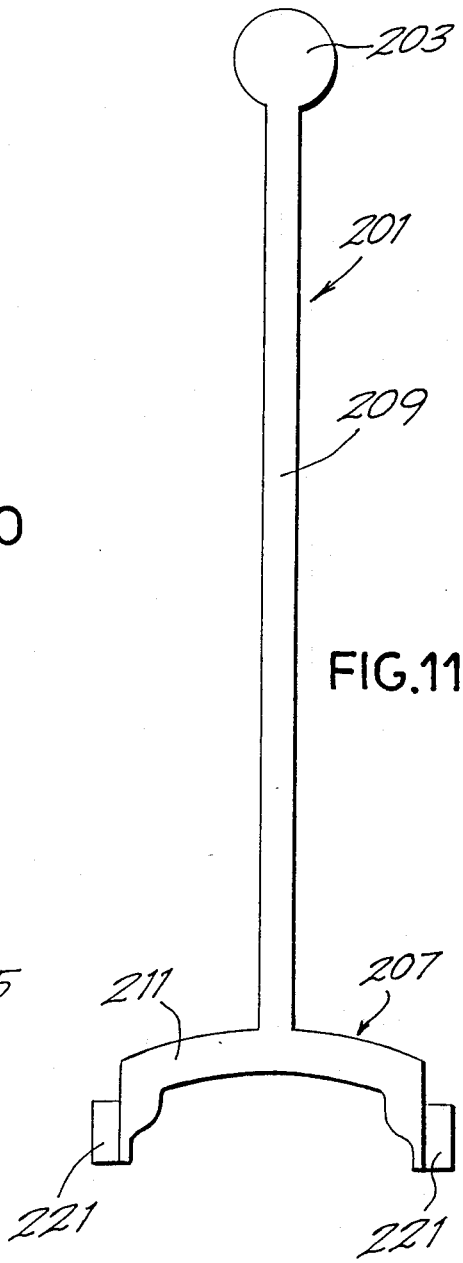
Figure 12:
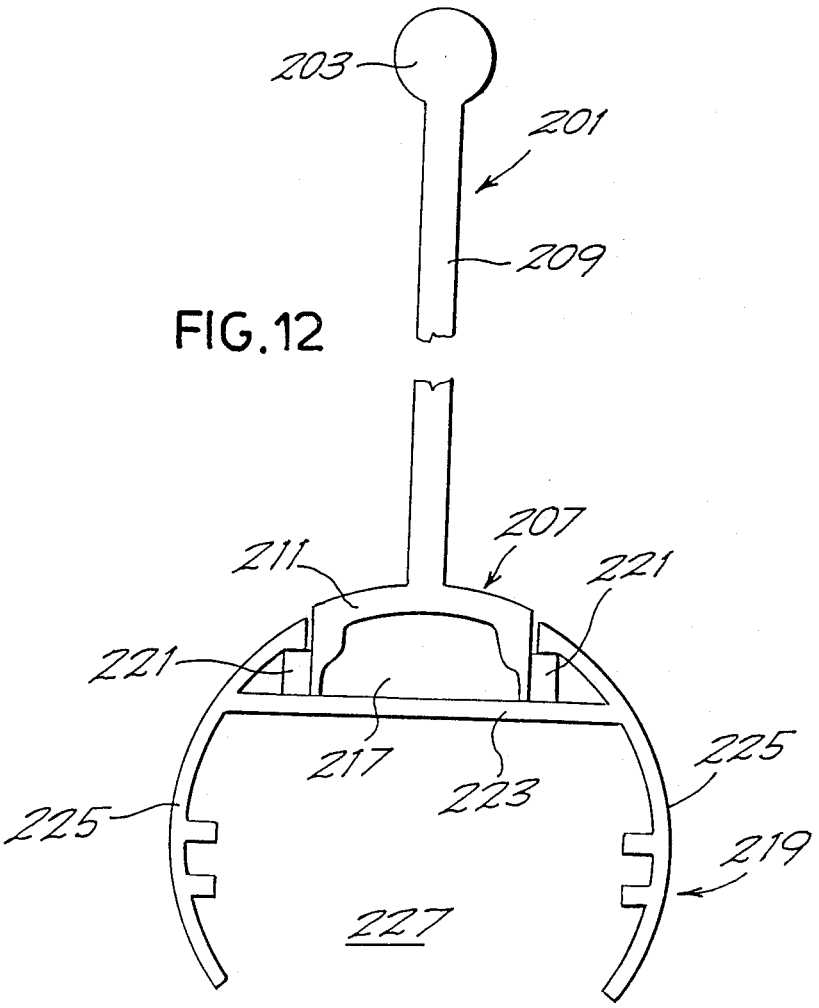
FIG. 12 shows a transverse section of the linear member engaged in a rail.

As is shown in FIG. 10, the portion 205 possesses, in section, an arcuate zone 211 ending in two enlargements 213 suitable for engaging within a duct 217 formed within a rail, generically indicated by 219, suitable for bearing electrical wiring and/or lighting apparatus and the like. In FIG. 11 the end portion of the linear member 201 opposite the expanded part 203 is indicated by 207 and is produced in a similar manner to that shown in FIG. 10, except for the different design of the end enlargements of the arcuate zone 211, which in this case have a more complex section in order to adapt to a different design of a corresponding receiving duct produced in the rail 219, and are indicated by 221.

Figure 13:
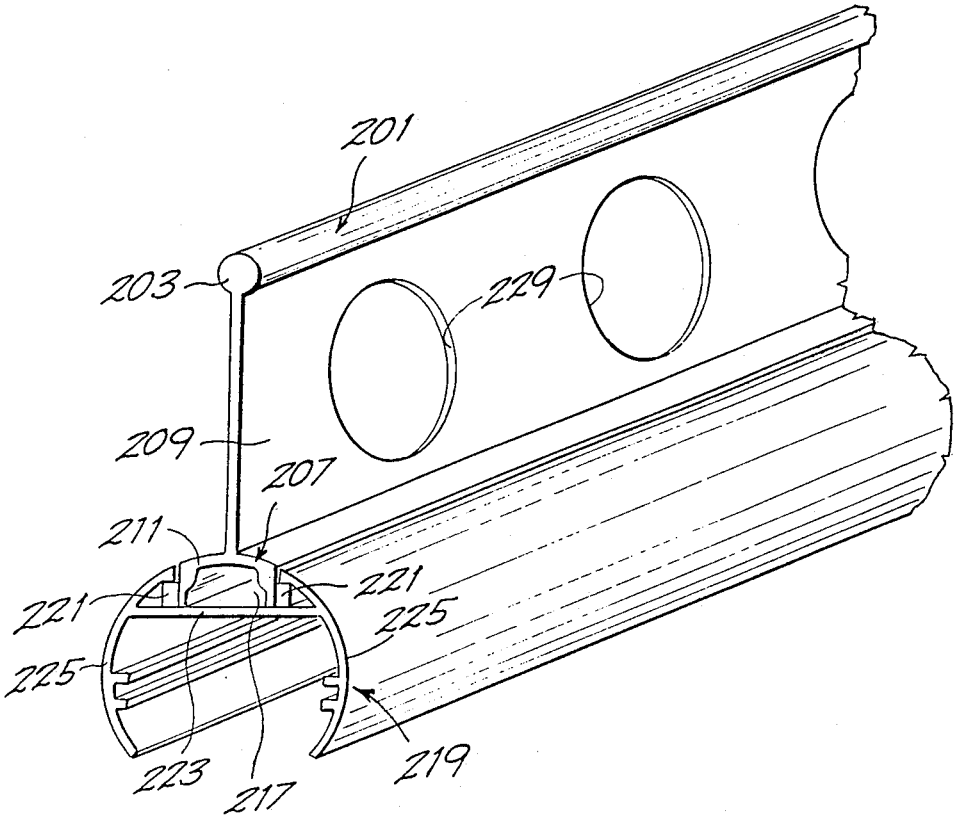
FIG. 13 shows a perspective view of the connected linear member and rail.

FIG. 13 shows the linear element 201 connected to a rail 219, in a perspective view. The rail 219 possesses a diaphragm 223 which joins two cylindrical shell portions 225 and defines (at the top in the drawing) the duct 217 for receiving the portions 205 and 207 respectively of the linear member, and at the bottom a duct 227 into which is introduced an extruded section, for example made from synthetic resin, bearing the contacts, running along the rail and providing the seatings in which are engaged the lighting apparatuses (adapters) to be fitted to the said rail 219.

The linear member 201 may possess, in its central connecting portion, slots 229 to reduce the weight of the structure.

Electrical wiring and the like may be fitted along the rail 219 and/or along the linear member 201, without the need for suitable seatings running along the rail, entailing high product costs.

With the element according to the solution shown in FIGS. 10 to 13, it is possible to produce separately the linear member 201 and the rail 219 to be linked thereto, resulting in a reduction in the final bulk of the units, which can be packaged, packed and hence marketed separately with a great reduction in bulk.

I claim:

1. A linear structural member for the formation of reticulated structures intended to bear lighting means comprising:

a single continuous section of enhanced area (1,203), two mutually spaced longitudinal expanded parts (1,3,201,219) with connecting means therebetween comprising a continuous linear web-like baffle (5,209), said continuous section comprising contiguous abutting segments connected in end-toend relationship by splice plates (7) connected to said baffles (5,209), said baffles (5,209) having cut-out weight-reducing slots (5A,229), an arcuate zone formed by connecting parts (8,205,207) which terminates at said longitudinal expanded parts (3,213,221), said longitudinal expanded parts designed as a rail (3,219) comprising two cylindrical shell portions connected by a diaphragm to form a duct between said arcuate portion and said diaphragm (223), said rail (3) of said expanded parts being designed to support light apparatuses therealong, said slots (5A,229) of said baffle being characterized by ribs along said continuous section, said continuous baffle (5,209) being of sufficient width to strengthen said structural member.

2. The linear structural member of claim 1, wherein said connecting parts (205,207) for engaging rail (219) possess end enlargements (213,221).

3. The linear structural member of claim 1, wherein electrical wiring can be fitted to said member.

* * * * *